US007549877B1

(12) United States Patent
Vista, Jr. et al.

(10) Patent No.: US 7,549,877 B1
(45) Date of Patent: Jun. 23, 2009

(54) DUAL PLUG ELECTRONIC DEVICE CHARGER

(75) Inventors: Fidel P. Vista, Jr., Pinas (PH); Randy John T. Delos Santos, San Fernando (PH)

(73) Assignee: Astec International Limited, Kwun Tong, Kowloon (HK)

( * ) Notice: Subject to any disclaimer, the term of this patent is extended or adjusted under 35 U.S.C. 154(b) by 29 days.

(21) Appl. No.: 12/011,287

(22) Filed: Jan. 25, 2008

(51) Int. Cl.
*H01R 29/00* (2006.01)

(52) U.S. Cl. ..... 439/172; 439/640

(58) Field of Classification Search ..... 439/131, 439/171–173, 217, 518, 640, 956
See application file for complete search history.

(56) References Cited

U.S. PATENT DOCUMENTS

| | | | | |
|---|---|---|---|---|
| 3,458,794 | A | | 7/1969 | Bohnstedt et al. |
| 4,013,330 | A | * | 3/1977 | Hugly ..... 439/172 |
| 4,467,263 | A | | 8/1984 | Conforti et al. |
| 4,702,007 | A | | 10/1987 | Nomura et al. |
| 4,857,702 | A | | 8/1989 | Cafaro |
| 4,997,381 | A | | 3/1991 | Oh |
| 5,160,879 | A | | 11/1992 | Tortola et al. |
| 5,220,152 | A | | 6/1993 | Doran |
| 5,401,178 | A | | 3/1995 | Liu |
| 5,648,712 | A | | 7/1997 | Hahn |
| D383,115 | S | | 9/1997 | Nagele et al. |
| 6,062,880 | A | | 5/2000 | Skuza |
| 6,126,460 | A | | 10/2000 | Wu |
| 6,261,109 | B1 | | 7/2001 | Liu et al. |
| 6,312,271 | B1 | | 11/2001 | Tseng |
| D454,537 | S | | 3/2002 | O'Connor et al. |
| 6,398,566 | B1 | | 6/2002 | Chen |
| 6,454,578 | B1 | | 9/2002 | Yao |
| 6,494,727 | B2 | | 12/2002 | Wen-Ching |
| 6,520,787 | B1 | * | 2/2003 | Lott ..... 439/171 |
| 7,306,471 | B2 | | 12/2007 | Shau-din |
| 2002/0127898 | A1 | | 9/2002 | Liu |
| 2004/0073820 | A1 | | 4/2004 | Hsu |
| 2004/0204177 | A1 | | 10/2004 | Pon |
| 2004/0246341 | A1 | | 12/2004 | Lee et al. |

* cited by examiner

*Primary Examiner*—Tho D Ta
(74) *Attorney, Agent, or Firm*—Harness, Dickey & Pierce, P.L.C.

(57) ABSTRACT

An electrical device charger is provided. In various embodiments the charger includes a dual plug pivotally mounted within a plug reservoir of a charging unit. The dual plug includes a set of first pins and a set of second pins, wherein the first pins are fixedly oriented at substantially a 90° angle to the second pins. The first pins are structured for insertion into a first type of electrical supply receptacle and the second pins are structured for insertion into a second type of electrical supply receptacle.

21 Claims, 5 Drawing Sheets

DUAL PLUG ELECTRONIC DEVICE CHARGER

FIELD

The present teachings relate to electronic device chargers.

BACKGROUND

The statements in this section merely provide background information related to the present disclosure and may not constitute prior art.

Portable electronic devices, such as laptop computers, cell phones, MP3 players, DVD players, PDAs, etc., are common place in today's society. Such portable electronic devices typically utilize a rechargeable stored energy source, e.g., one or more rechargeable batteries, to provide electrical power needed to operate the respective device. Charging devices, e.g., AC adapters, are commonly employed to access a main power supply, via a respective power supply receptacle or outlet, and provide transformed and regulated power to the respective device for recharging the respective stored energy source.

The portable nature of such devices allows the device to literally be carried by the user to any geographic location in the world. Accordingly, a user may need to recharge the rechargeable energy source of the respective device at different geographic locations in the world. However, different geographic locations in the world have different main power supply standards and codes, and the structure of the respective power supply receptacles or outlets useable by a user to access the main power supply can differ from geographic location to geographic location. Thus, a charger configured and structured to mate with a first type of power supply receptacle for accessing the main power supply in a first geographical location, may not be configured and structured to mate with a second type of power supply receptacle for accessing the main power supply in a second geographical location. Accordingly, a plurality of different adapters may be required to be able to charge a device at different geographic locations in the world.

SUMMARY

An electrical device charger is provided. In various embodiments the charger includes a dual plug pivotally mounted within a plug reservoir of a charging unit. The dual plug includes a set of first pins and a set of second pins, wherein the first pins are fixedly oriented at substantially a 90° angle to the second pins. The first pins are structured for insertion into a first type of electrical supply receptacle and the second pins are structured for insertion into a second type of electrical supply receptacle.

In various other embodiments, the charger includes a dual plug component that comprises a set of first electrical pins structured for insertion into a first type of electrical supply receptacle and a set of second electrical pins fixedly positioned at substantially a 90° relationship with the first electrical pins. The second electrical pins are structured for insertion into a second type of electrical supply receptacle. The charger additionally can include a charging unit that comprises a plug reservoir into which the dual plug is pivotally mounted. In various implementations, the plug reservoir can include a first set of pin pockets for receiving the first set of electrical pins when the dual plug is pivotally oriented in a first charging position for insertion of the second set of electrical pins into the second type of electrical supply receptacle.

The plug reservoir can additionally include a second set of pin pockets for receiving the second set of electrical pins when the dual plug is pivotally oriented in a second charging position for insertion of the first electrical pins into the first type of electrical supply receptacle.

In yet other embodiments, the charger can comprise a dual plug component that includes a set of first electrical pins structured for insertion into a first type of electrical supply receptacle, a set of second electrical pins structured for insertion into a second type of electrical supply receptacle, and a body fixedly retaining the first electrical pins and the second electrical pins at substantially a 90° angle to each other. The body additionally fixedly retains the first electrical pins in a spaced apart relation with the second electrical pins within the body, wherein the space between the first and second electrical pins is sufficient to electrically isolate the first electrical pins from the second electrical pins. The charger can additionally comprise a charging unit that includes a plug reservoir into which the dual plug is pivotally mounted. In various implementations, the plug reservoir includes a first set of pin pockets and a second set of pin pockets. The first set of pin pockets are structured to receive the first set of electrical pins when the dual plug is pivotally oriented in a first charging position for insertion of the second set of electrical pins into the second type of electrical supply receptacle. Similarly, the second set of pin pockets are structured to receive the second set of electrical pins when the dual plug is pivotally oriented in a second charging position for insertion of the first electrical pins into the first type of electrical supply receptacle.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
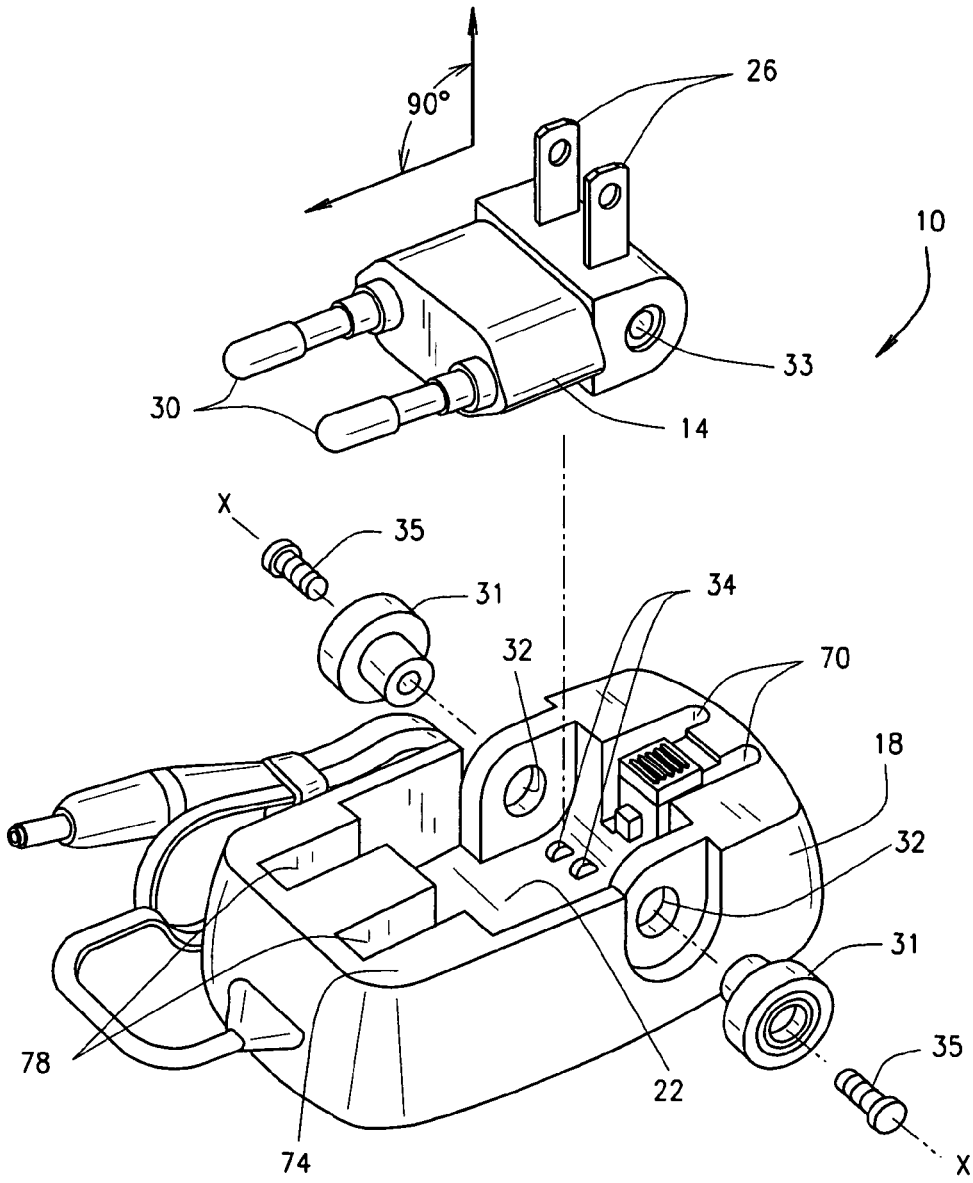
FIG. 1 is an isometric exploded view of an electronic device charger, in accordance with various embodiments of the present disclosure.

The following description is merely exemplary in nature and is in no way intended to limit the present teachings, application, or uses. Throughout this specification, like reference numerals will be used to refer to like elements.

Figure 1A:
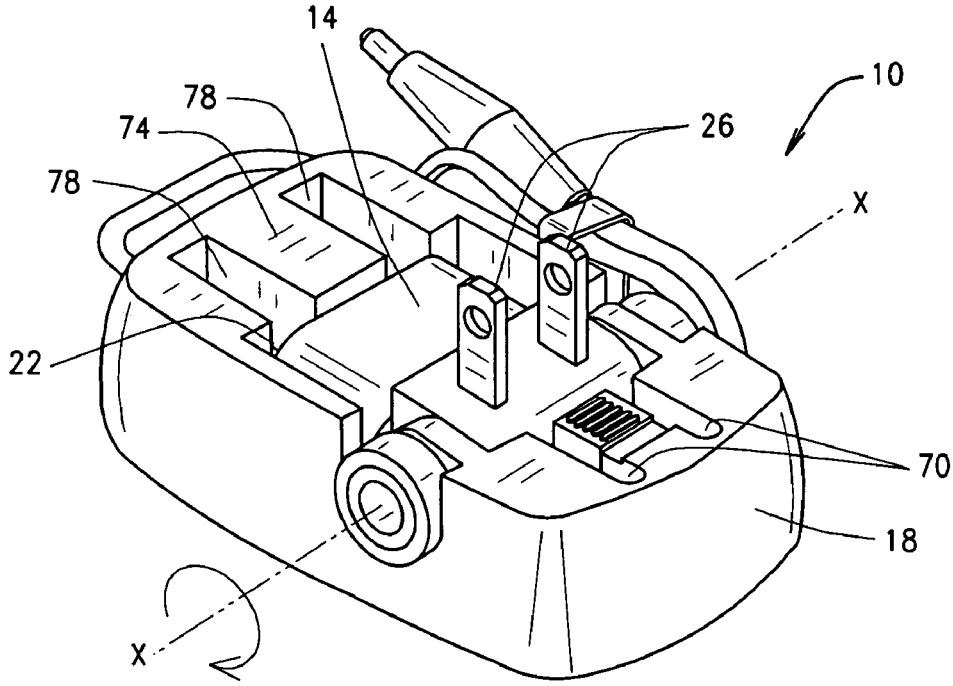
FIG. 1A is an isometric view of the electronic device charger, shown in FIG. 1, configured in a first charging position, in accordance with various embodiments of the present disclosure.
Figure 1B:
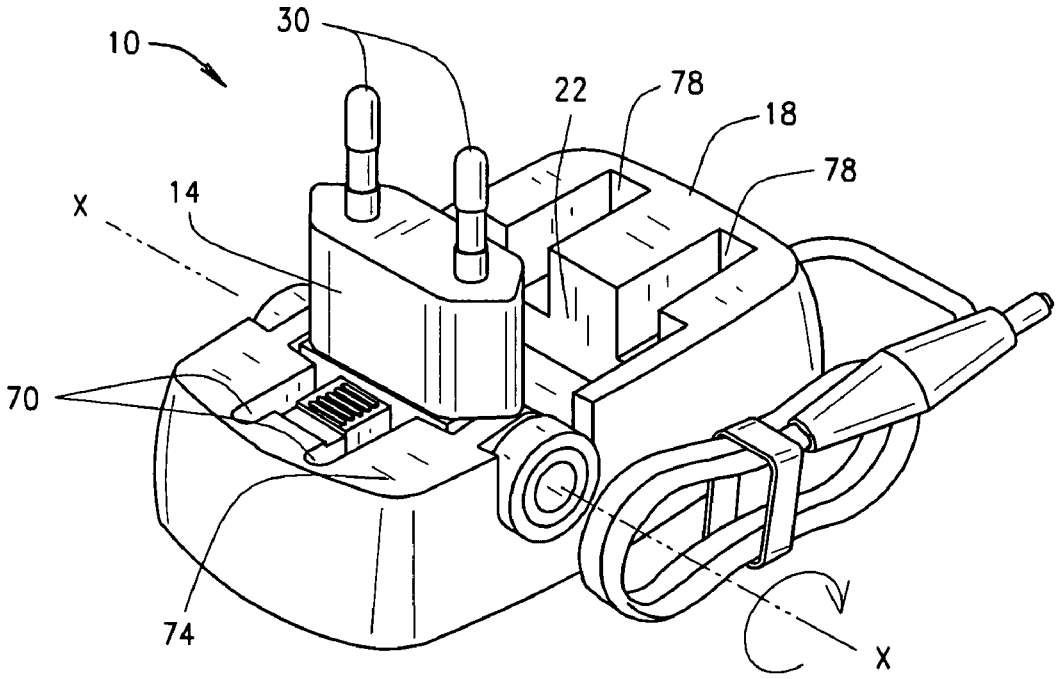
FIG. 1B is an isometric view of the electronic device charger, shown in FIG. 1, configured in a second charging position, in accordance with various embodiments of the present disclosure.

FIGS. 1, 1A and 1B, exemplarily illustrate a charger 10, e.g., an AC/DC converter, for charging a battery, or other power cell, of an electronic device such as a laptop computer, cell phone, MP3 player, DVD player, PDA, etc. Generally, the charger 10 includes a dual plug component 14 and a charging unit 18. The dual plug component 14 is structured to be pivotally mounted within a plug reservoir 22 of the charging unit 18 and to operably mate with, i.e., plug into, two different types of electrical supply receptacles (not shown), often commonly referred as electrical outlets. For example, in various embodiments, the dual plug component 14 can be structured to operably mate with electrical supply receptacles that conform to electrical standards and codes of the United States (US) and also operably mate with electrical supply receptacles that conform to electrical standards and codes of the European Union (EU).

More particularly, the dual plug component 14 includes a set of first electrical pins 26, e.g., pins, prongs, tines or blades, that are structured to mate with, i.e., be inserted into, a first type of electrical supply receptacle, and a set of second electrical pins 30, e.g., pins, prongs, tines or blades, that are structured to mate with, i.e., be inserted into, a second type of electrical supply receptacle that is different from the first type of electrical supply receptacle. Specifically, the first pins 26 will not mate with the second type of electrical supply receptacle and the second pins will not mate with the first type of electrical supply receptacle. The dual plug component 14 is pivotally mounted within the plug reservoir 22 such that the dual plug component 14 can be pivoted about an axis X between a first charging position, exemplarily shown in FIG. 1A, and second charging position, exemplarily shown in FIG. 1B. The dual plug component 14 can be pivotally mounted within the plug reservoir 22 utilizing any suitable pivotal connecting means. For example, as shown in FIG. 1, in various embodiments, the dual plug component 14 is pivotally mounted within the plug reservoir 22 utilizing plugs 31 inserted through apertures 32 in side walls of the reservoir 22 and pivotally retained within receiving pockets 33 of the dual plug component 14 by screws 35.

Additionally, the first pins 26 and second pins 30 are fixedly, or non-movably, retained within the dual plug component 14 having approximately a 90° orientation relative to each other. That is, the first and second pins 26 and 30 are fixedly, or non-movably, retained in the dual plug component 14 such that there is a fixed angle of approximately 90° between any one of the first pins 26 and any one of the second pins 30. Accordingly, the first and second pins 26 and 30 can not be moved within dual plug component 14 and the approximately 90° angle relationship between the first pins 26 and the second pins 30 can not be altered. Only the pivotal orientation of the dual plug component 14 about the X axis can be altered when pivoting the dual plug component 14 between the first charging position (e.g., FIG. 1A) and the second charging position (e.g., FIG. 1B). Therefore, regardless of the pivotal position of the dual plug component 14 about the axis X, the approximately 90° angle between the first and second pins 26 and 30 will be maintained.

The dual plug component 14 is additionally structured to electrically connect with a pair of charging contacts 34 located in a bottom of the plug reservoir 22. When the dual plug component 14 is pivotally positioned in the first charging position, distal end portions 38 of tails 42 of the first pins 26 (shown and described below with regard to FIGS. 2 and 3) make electrical contact with the charging contacts 34, thereby providing electrical continuity between heads 46 of the first pins 26 and the contacts 34. Additionally, when the dual plug component 14 is pivotally positioned in the second charging position, distal end portions 50 of tails 54 of the second pins 30 (shown and described below with regard to FIGS. 2 and 3), make electrical contact with the charging contacts 34, thereby providing electrical continuity between heads 58, thereby providing electrical continuity between heads 58 of the second pins 30 and the contacts 34.

To accommodate and safely stow the first pins 26 when the dual plug component 14 is pivotally oriented in the second position (shown in FIG. 1B), the plug reservoir 22 includes a set of first pin pockets 70. More particularly, when the dual plug component 14 is pivoted into the second position, the first pins 26 are stowed within the first pin pockets 70, below a face 74 of the charging unit 18. Stowing the first pins 26 within the first pin pockets 70, below the charging unit face 74 prevents the first pins 26 from interfering with insertion of the second pins 30 into a corresponding second type of electrical supply receptacle. Similarly, to accommodate and safely stow the second pins 30 when the dual plug component 14 is pivotally oriented in the first position (shown in FIG. 1A), the plug reservoir 22 includes a set of second pin pockets 78. Accordingly, when the dual plug component 14 is pivoted into the first position, the second pins 30 are stowed within the second pin pockets 78, below the face 74 of the charging unit 18. Stowing the second pins 30 within the second pin pockets 78, below the charging unit face 74 prevents the second pins 30 from interfering with insertion of the first pins 26 into a corresponding first type of electrical supply receptacle.

Figure 2:
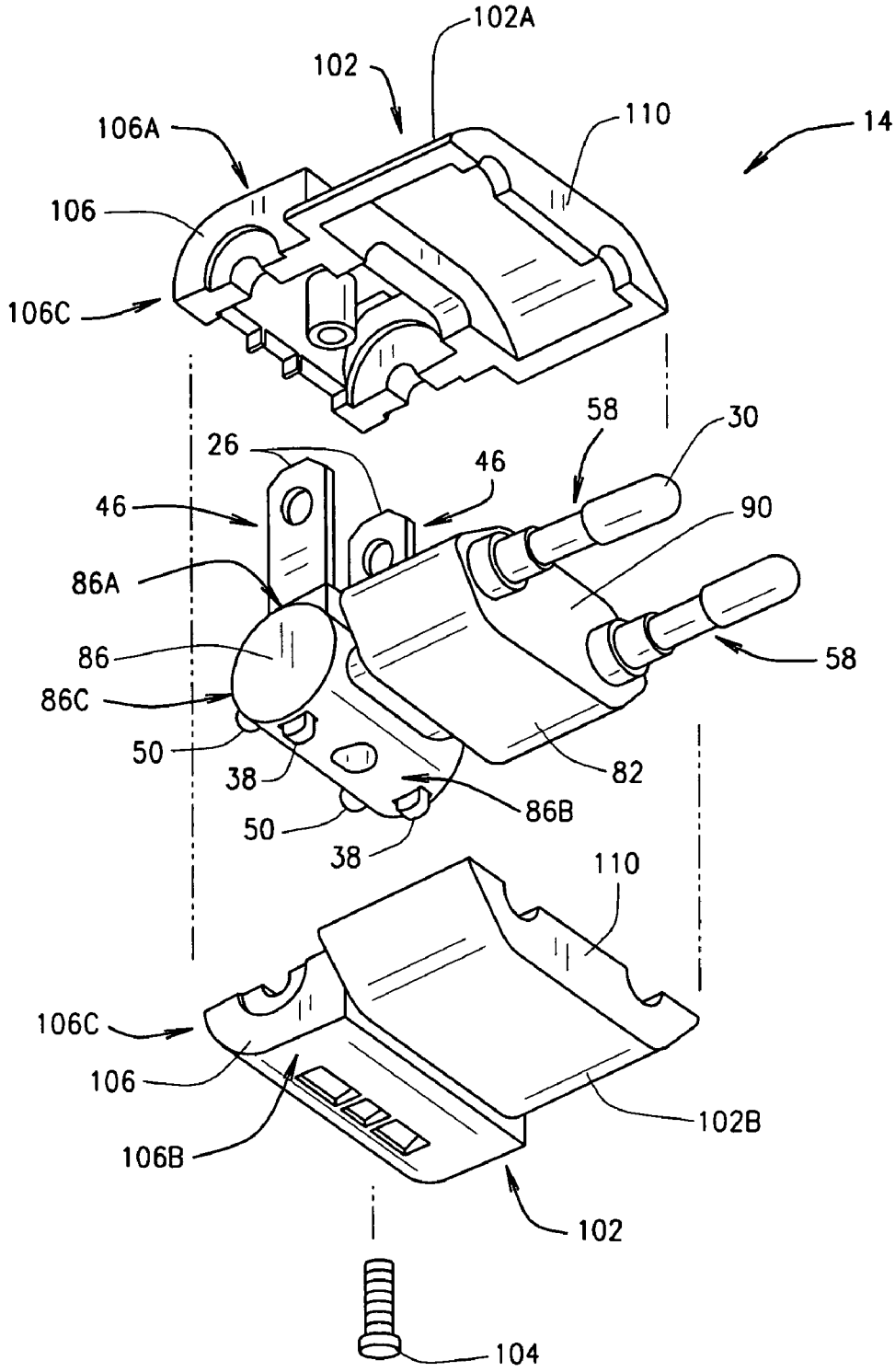
FIG. 2 is an isometric exploded view of a dual plug component of the electronic device charger, shown in FIG. 1, in accordance with various embodiments of the present disclosure.
Figure 3:
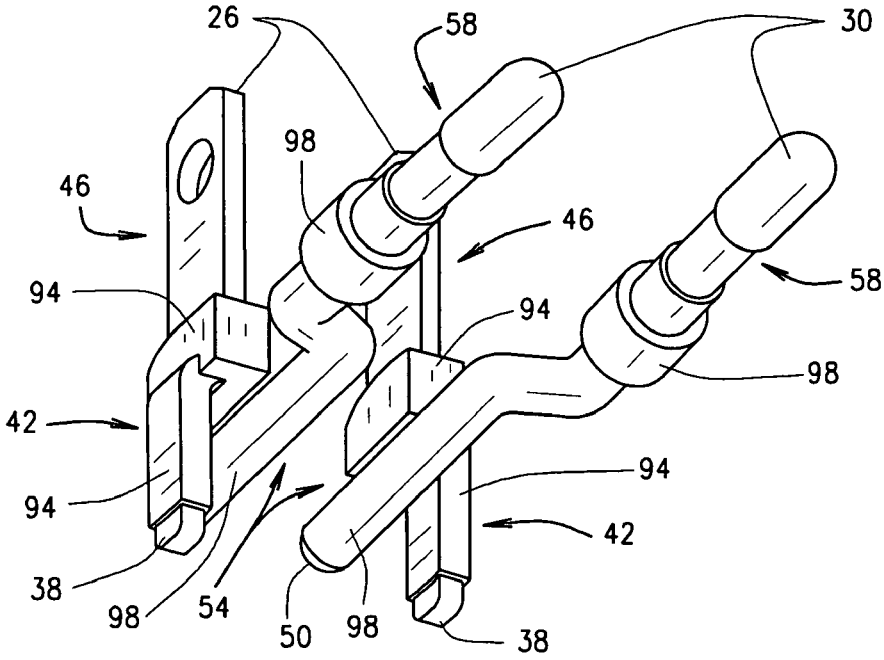
FIG. 3 is an isometric view of first and second electrical pins fixedly retained within the dual plug component of the electronic device charger, shown in FIG. 1, in accordance with various embodiments of the present disclosure.

Referring now to FIGS. 2 and 3, the dual plug component 14 still further includes a body 82 that fixedly retains the first and second electrical pins 26 and 30 in the substantially 90° relationship. Moreover, the body 82 fixedly retains the first pins 26 sufficiently spaced apart from second electrical pins 30 such that the first and second pins 26 and 30 are electrically isolated from each other. As exemplarily illustrated in FIG. 3, in various embodiments the first and second pins 26 and 30 are structured such that the respective tails 42 and 54 are sufficiently spaced apart to electrically isolate the first pins 26 from the second pins 30. The electrical isolation provided by the fixed spaced apart relation between the first and second pins 26 and 30 prevents electrical shock to a person who might inadvertently contact the first pins 26 when the second pins 30 are making electrical contact with a respective corresponding second type of electrical supply receptacle. Likewise, the electrical isolation provided by the fixed spaced apart relation between the first and second pins 26 and 30 prevents electrical shock to a person who might inadvertently contact the second pins 30 when the first pins 26 are making electrical contact with a respective corresponding first type of electrical supply receptacle.

To provide additional electrical isolation between the first and second pins 26 and 30, in various embodiments, the respective tails 42 and 54 are coated with, or encapsulated in, an electrical insulating material. More particularly, the first pin tails 42 are each coated with, or encapsulated in, a respective first dielectric jacket 94 fabricated from a electrically non-conductive, flame retardant material, such as Polycarbonate (PC), an alloy comprising PC and Acrylonitrile Butadiene Stryrene (ABS), nylon, etc., leaving the distal end portions 38 exposed for electrically connecting the first pins 26 to the charging contacts 34 (FIG. 1), as described herein. Similarly, each of the second pin tails 54 are coated with, or encapsulated in, a respective second dielectric jacket 98 fabricated from a electrically non-conductive, flame retardant material, such as PC, an alloy comprising PC and ABS, nylon, etc., leaving the distal end portions 50 exposed for electrically connecting the second pins 30 to the charging contacts 34 (FIG. 1), as described herein. Thus, in various embodiments, the spaced apart first and second pin tails 42 and 54 can be coated with the respective first and second dielectric jackets 94 and 98 to provide two layers of electrical insulation between the first and second pins 26 and 30 to electrically isolate the first and second pins 26 and 30.

In various embodiments, the body includes a first end 86 and an opposing second end 90. The first end 86 generally includes a first side 86A, an opposing second side 86B and third side 86C connecting the first and second sides 86A and 86B. As exemplarily illustrated in FIG. 2, the heads 46 of the first pins 26 extend from the first side 86A and the distal end portions 38 of the first pin tails 42 extend from the opposing second side 86B. Additionally, the heads 58 of the second pins 30 extend from the second end 90 of the body 82 and the distal end portions 50 of second pin tails 54 extend from the opposing third side 86C of the first end 86 of the dual plug component body 82. In various embodiments, the body 82 is a molded component having the first and second pins 26 and 30 molded therein to fixedly retain the first and second pins 26 and 30 in the electrically isolating spaced apart relation, having the approximately 90° orientation with respect to each other. However, alternatively the body 82 can be fabricated in manner suitable to fixedly retain the first and second pins 26 and 30 in the electrically isolating spaced apart relation, having the approximately 90° orientation with respect to each other.

To provide still further electrical isolation between the first and second pins 26 and 30, in various embodiments, the body 82 is fabricated from an electrically non-conductive, flame retardant material such as PC, an alloy comprising PC and ABS, nylon, etc. Thus, in various embodiments, the spaced apart first and second pin tails 42 and 54 can be coated with the respective first and second dielectric jackets 94 and 98 and fixedly retained within the body 82 fabricated from an electrically non-conductive material to provide three layers of electrical insulation between the first and second pins 26 and 30 to electrically isolate the first and second pins 26 and 30. For manufacturability, in various embodiments, the electrically non-conductive material of the first and second pin tail jackets 94 and 98 have a higher hardness and temperature rating than the electrically non-conductive material of the body 82.

Figure 4:
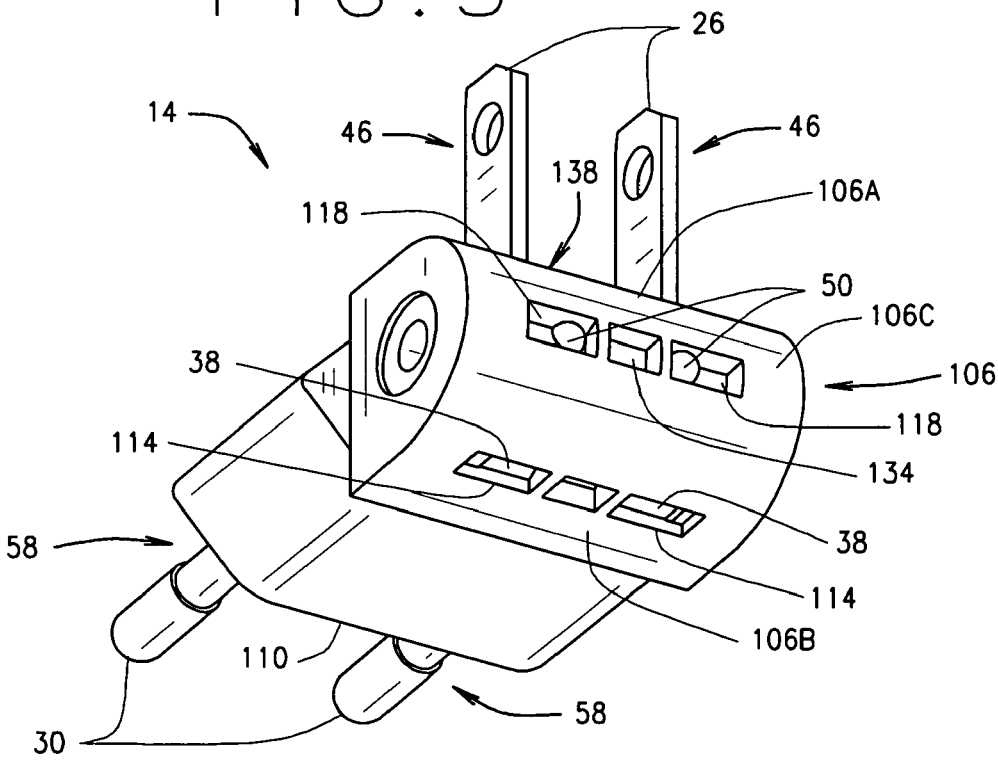
FIG. 4 is an isometric view of the dual plug component shown in FIG. 2, in an assembled state, in accordance with various embodiments of the present disclosure.

Referring now to FIGS. 2 and 4, the dual plug component 14 can further include a housing 102 that encloses the body 82. Particularly, in various embodiments, the housing can be constructed of a first half 102A connected to a second half 102B enclosing the body 82 therein and having the first and second pins 26 and 30 extending therefrom. The first and second halves 102A and 102B can be connected together using any suitable connecting means. For example, in various embodiments, the first and second halves 102A and 102B can be ultrasonically welded together. Or, for additional reliability, in various embodiments, the first and second halves 102A and 102B can be ultrasonically welded and screwed together, via a screw 104. In various implementations, the housing 102 can be fabricated from an electrically non-conductive, flame retardant material such as PC, an alloy comprising PC and ABS, nylon, etc.

Corresponding with the body 82, the housing 102 includes a first end 106 and an opposing second end 110. The first end 106 generally includes a first side 106A, an opposing second side 106B and third side 106C connecting the first and second sides 106A and 106B. As exemplarily illustrated in FIG. 4, the heads 46 of the first pins 26 extend from the first side 106A and the distal end portions 38 of the first pin tails 42 extend into, but not out of, first pin windows 114 formed in the second side 106B. Thus, when the dual plug component is oriented in the first charging position (FIG. 1A) the charging unit charging contacts 34 protrude into the first pin windows 114 and electrically contact, i.e., make electrical connection with, the first pin tail distal end portions 38, thereby providing electrical continuity between heads 46 of the first pins 26 and the charging contacts 34.

Additionally, the heads 58 of the second pins 30 extend from the second end 110 and the distal end portions 50 of second pin tails 54 extend into, but not out of, second pin windows 118 formed in the third side 106C. Thus, when the dual plug component is oriented in the second position (FIG. 1B) the charging unit charging contacts 34 protrude into the second pin windows 118 and electrically contact, i.e., make electrical connection with, the second pin tail distal end portions 50, thereby providing electrical continuity between heads 58 of the second pins 30 and the charging contacts 34.

Figure 5:
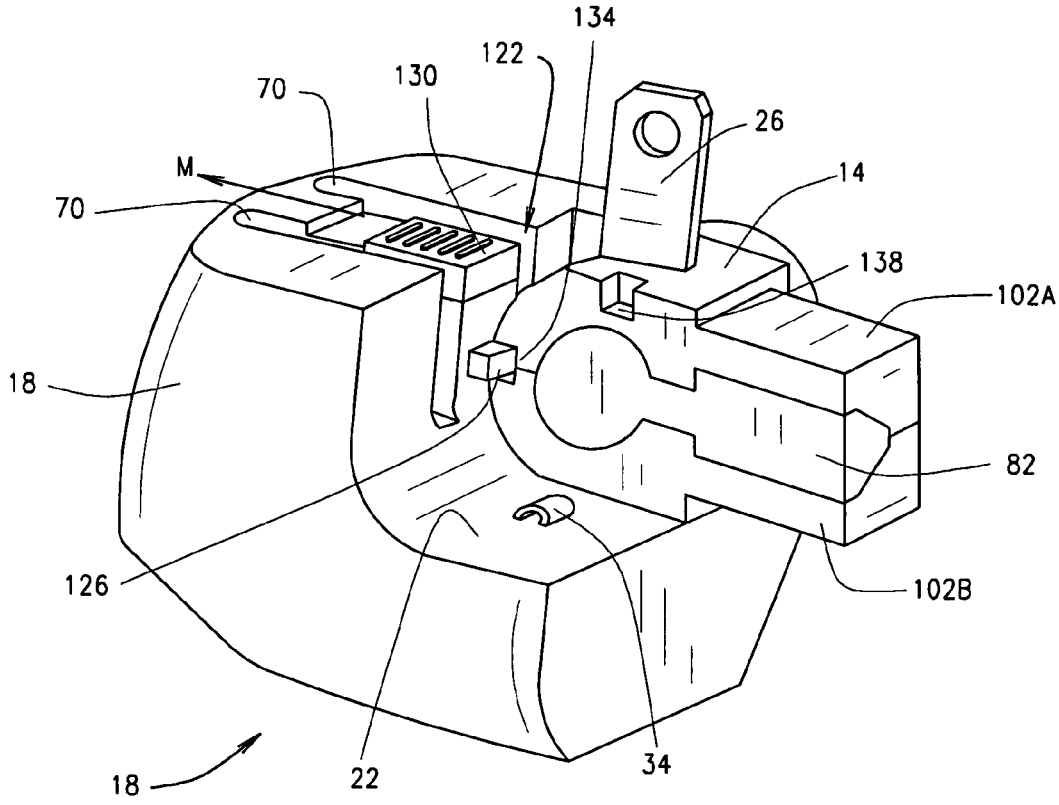
FIG. 5 is a isometric, cut-away view of the electronic device charger shown in FIG. 1, illustrating a locking mechanism, in accordance with various embodiments of the present disclosure.

Referring now to FIGS. 4 and 5, in various embodiments, the charger 10 includes a locking mechanism, generally indicated at 122, for releasably locking the dual plug component in each of the first and second charging positions. Generally, the locking mechanism includes a tongue 126 connected to a release slide 130 and a biasing device (not shown) operable to normally maintain the tongue 126 in an locking position, extending or protruding from a wall of the plug reservoir 22, as illustrated in FIG. 5. Although it is not shown, in light of FIG. 5, one skilled in the art would easily and readily understand that the tongue 126 is connected to the release slide 130 within a cavity (not shown) internal to the charging unit 18 between the first pin pockets 70, and that the biasing device would also be located and operable within the internal cavity. The biasing device can be an biasing device suitable to exert a biasing force on the tongue 126 to maintain the tongue 126 in the normally extended position, but compressive to allow the release slide 130 to be moved in the M direction to retract the tongue 126. For example, the biasing device can be a spring or any other suitable resilient compressive device, component or mechanism.

Additionally, the dual plug component housing 102 includes a first tongue receiver 134 and a second tongue receiver 138. The first tongue receiver 134 is formed within the housing first end third side 106C between the second pin windows 118. And the second tongue receiver 138 is formed within housing first end first side 106A between the first pin heads 46. Each of the first and second tongue receivers 134 and 138 are sized and shaped to receive the tongue 126 when the tongue is in the locking position, extending or protruding from a wall of the plug reservoir 22, thereby locking the dual plug component 14 in the respective first or second charging position.

Therefore, to utilize the charger 10, the dual plug component is pivotally oriented in the desired first or second charging position, depending on the respective power supply outlet to be utilized. For example, if a first type of power supply is to be utilized to access a main electrical power supply, the dual plug component 14 is pivoted to the first charging position. When oriented in the first charging position the first pin heads 46 extend from the charging unit 18, the second pin heads 58 are stowed in the second pin pockets 78 (FIG. 1), and the charging contacts are in electrical contact with the first pin tail distal end portions 38 (FIG. 3). Once the dual plug component 14 is oriented in the first charging position, the force of the biasing device will force the tongue 126 into the first tongue receiver 134, thereby releasably locking, or retaining, the dual plug component 14 in the first charging position.

Subsequently, if a second type of power supply is to be utilized to access a main electrical power supply, the release slide 130 is moved in the M direction retracting the tongue 126 from protruding into the first tongue receiver 134. While the tongue 126 is retracted, the dual plug component 14 is pivoted to the second charging position having the second pin heads 58 extending from the charging unit 18, the first pin heads 46 stowed in the first pin pockets 70 (FIG. 1), and the charging contacts are in electrical contact with the second pin tail distal end portions 50 (FIG. 3). Once the dual plug component is oriented in the second charging position, the release slide 130 is released and the force of the biasing device will force the tongue 126 into the second tongue receiver 138, thereby releasably locking, or retaining, the dual plug component 14 in the second charging position.

Although the terms first, second, third, etc., have been used herein to describe various elements, components, regions and/or sections, these elements, components, regions and/or sections, it should be understood that these terms are only utilized to distinguish between similar elements components, regions and/or sections. The terms first, second, third, etc., are not used herein to identify any sequence or a degree of priority, preference or importance, and the terms should not be so limited.

Additionally, the description herein is merely exemplary in nature and, thus, variations that do not depart from the gist of that which is described are intended to be within the scope of the teachings. Such variations are not to be regarded as a departure from the spirit and scope of the teachings.

What is claimed is:

1. An electronic device charger, said charger comprising a dual plug pivotally mounted within a plug reservoir of a charging unit, the dual plug including a set of first pins and a set of second pins, the first pins fixedly oriented at substantially a 90° angle to the second pins, the first pins structured for insertion into a first type of electrical supply receptacle and the second pins structured for insertion into a second type of electrical supply receptacle.

2. The charger of claim 1, wherein the charging unit plug reservoir is structured to include a set of first pin pockets for receiving the first electrical pins when the dual plug is oriented in a first charging positioned, and a set of second pin pockets for receiving the second electrical pins when the dual plug is oriented in a second charging position that is substantially 90° pivotally different from the first charging position.

3. The charger of claim 2, wherein the dual plug comprises a body having a first end and an opposing second end, the body structured to fixedly retain the first and second pins in the substantially 90° relationship such that heads of the first pins extend from a first side of the first end and distal end portions of tails of the first pins extend from an opposing second side of the first end, and heads of the second pins extend from the second end and distal end portions of tails of the second pins extend from a third side of the first end.

4. The charger of claim 3, wherein the dual plug further comprises a housing fabricated from a non-electrically conductive material and structured to enclose the body such that the first pin heads, the distal end portions of the first pin tails, the second pin heads, and the distal end portions of the second pin tails extend therefrom.

5. The charger of claim 3, wherein the charging unit includes a pair of exposed electrical contacts located in a bottom of the plug reservoir such that when the dual plug is oriented in the first charging position the contacts are in electrical connection with the distal end portions of the second pin tails, and when the dual plug is oriented in the second charging position, the contacts are in electrical connection with the distal end portions of the first pin tails.

6. The charger of claim 3, wherein the body is further structured to fixedly retain the first and second pins in the substantially 90° relationship having sufficient space between the tails of the first pins and the tails of the second pins to electrically isolate the first pin tails from the second pin tails.

7. The charger of claim 6, wherein at least a non-distal end portion of each of the first pin tails are covered with a first dielectric jacket and at least a non-distal end portion of each of the second pin tails are covered with a second dielectric jacket, thereby electrically isolating the first pin tails from the second pin tails.

8. An electronic device charger, said charger comprising:

a dual plug component comprising:

a set of first electrical pins structured for insertion into a first type of electrical supply receptacle; and a set of second electrical pins fixedly position at substantially a 90° relationship with the first electrical pins, the second electrical pins structured for insertion into a second type of electrical supply receptacle; and a charging unit comprising a plug reservoir into which the dual plug is pivotally mounted, the plug reservoir including:

a first set of pin pockets for receiving the first set of electrical pins when the dual plug is pivotally oriented in a first charging position for insertion of the second set of electrical pins into the second type of electrical supply receptacle; and a second set of pin pockets for receiving the second set of electrical pins when the dual plug is pivotally oriented in a second charging position for insertion of the first electrical pins into the first type of electrical supply receptacle.

9. The charger of claim 8, wherein the first and second pins are molded into the body and the body is fabricated from an electrically non-conductive material to electrically isolate the first pins from the second pins.

10. The charger of claim 8, wherein the dual plug comprises a body having a first end and an opposing second end, the body structured to fixedly retain the first and second electrical pins in the substantially 90° relationship such that heads of the first electrical pins extend from a first side of the first end of the dual plug and distal end portions of tails of the first electrical pins extend from an opposing second side of the first end of the dual plug, and heads of the second electrical pins extend from the second end of the dual plug and distal end portions of tails of the second electrical pins extend from a third side of the first end of the dual plug.

11. The charger of claim 10, wherein the dual plug further comprises a housing fabricated from a non-electrically conductive material and structured to enclose the body such that the first pin heads, the distal end portions of the first pin tails, the second pin heads, and the distal end portions of the second pin tails extend therefrom.

12. The charger of claim 10, wherein the charging unit comprises a pair of exposed electrical contacts located in a bottom of the plug reservoir such that when the dual plug is oriented in the first charging position the contacts are in electrical connection with the distal end portions of the second pin tails, and when the dual plug is oriented in the second charging position, the contacts are in electrical connection with the distal end portions of the first pin tails.

13. The charger of claim 10, wherein the body is further structured to fixedly retain the first and second electrical pins in the substantially 90° relationship having sufficient space between the tails of the first electrical pins and the tails of the second electrical pins to electrically isolate the first pin tails from the second pin tails.

14. The charger of claim 10, wherein at least a non-distal end portion of each of the first pin tails are covered with a first dielectric jacket and at least a non-distal end portion of each of the second pin tails are covered with a second dielectric jacket, thereby electrically isolating the first pin tails from the second pin tails.

15. The charger of claim 10, wherein the first and second electrical pins are molded into the body and the body is fabricated from an electrically non-conductive material to electrically isolate the first electrical pins from the second electrical pins.

16. An electronic device charger, said charger comprising:

a dual plug component comprising:

a set of first electrical pins structured for insertion into a first type of electrical supply receptacle;

a set of second electrical pins structured for insertion into a second type of electrical supply receptacle; and a body fixedly retaining the first electrical pins and the second electrical pins at substantially a 90° angle to each other and in a spaced apart relation within the body sufficient to electrically isolate the first electrical pins from the second electrical pins; and a charging unit comprising a plug reservoir into which the dual plug is pivotally mounted, the plug reservoir including:

a first set of pin pockets for receiving the first set of electrical pins when the dual plug is pivotally oriented in a first charging position for insertion of the second set of electrical pins into the second type of electrical supply receptacle; and a second set of pin pockets for receiving the second set of electrical pins when the dual plug is pivotally oriented in a second charging position for insertion of the first electrical pins into the first type of electrical supply receptacle.

17. The charger of claim 16, wherein the dual plug comprises a body having a first end and an opposing second end, the body structured to fixedly retain the first and second electrical pins in the substantially 90° relationship such that heads of the first electrical pins extend from a first side of the first end of the dual plug and distal end portions of tails of the first electrical pins extend from an opposing second side of the first end of the dual plug, and heads of the second electrical pins extend from the second end of the dual plug and distal end portions of tails of the second electrical pins extend from a third side of the first end of the dual plug.

18. The charger of claim 17, wherein the dual plug further comprises a housing fabricated from a non-electrically conductive material and structured to enclose the body such that the first pin heads, the distal end portions of the first pin tails, the second pin heads, and the distal end portions of the second pin tails extend therefrom.

19. The charger of claim 17, wherein the charging unit comprises a pair of exposed electrical contacts located in a bottom of the plug reservoir such that when the dual plug is oriented in the first charging position the contacts are in electrical connection with the distal end portions of the second pin tails, and when the dual plug is oriented in the second charging position, the contacts are in electrical connection with the distal end portions of the first pin tails.

20. The charger of claim 17, wherein at least a non-distal end portion of each of the first pin tails are covered with a first dielectric jacket and at least a non-distal end portion of each of the second pin tails are covered with a second dielectric jacket, thereby electrically isolating the first pin tails from the second pin tails.

21. The charger of claim 20, wherein the first and second electrical pins are molded into the body and the body is fabricated from an electrically non-conductive material to electrically isolate the first electrical pins from the second electrical pins.

* * * * *